US009080472B2

(12) United States Patent
Blaxill et al.

(10) Patent No.: US 9,080,472 B2
(45) Date of Patent: Jul. 14, 2015

(54) VALVE TRAIN OF A RECIPROCATING PISTON COMBUSTION ENGINE

(75) Inventors: Hugh Blaxill, Oxfordshire (GB); Falk Schneider, Korntal-Münchingen (DE)

(73) Assignee: Mahle International GmbH (DE)

( * ) Notice: Subject to any disclaimer, the term of this patent is extended or adjusted under 35 U.S.C. 154(b) by 1591 days.

(21) Appl. No.: 12/527,343

(22) PCT Filed: Feb. 14, 2008

(86) PCT No.: PCT/EP2008/051805
§ 371 (c)(1),
(2), (4) Date: Apr. 1, 2010

(87) PCT Pub. No.: WO2008/098991
PCT Pub. Date: Aug. 21, 2008

(65) Prior Publication Data

US 2010/0212625 A1 Aug. 26, 2010

(30) Foreign Application Priority Data

Feb. 16, 2007 (DE) ..... 10 2007 007 758

(51) Int. Cl.
*F02D 13/04* (2006.01)
*F01L 1/344* (2006.01)
(Continued)

(52) U.S. Cl.
CPC ..... *F01L 1/34413* (2013.01); *F01L 1/047* (2013.01); *F01L 1/26* (2013.01); *F01L 13/06* (2013.01)

(58) Field of Classification Search
CPC ..... F02D 41/32; F02D 41/402; F02M 9/102; F01L 1/02; F01L 1/06; F01L 1/12; F01L 1/26; F01L 1/3442; F01L 13/06; F01L 13/065; F01L 13/0042; F01L 2105/00; F01L 9/04
USPC ..... 123/90.1, 90.11, 90.16–90.18, 90.2, 123/90.21, 90.22, 90.31, 90.34, 90.4, 123/320–322, 299, 478
See application file for complete search history.

(56) References Cited

U.S. PATENT DOCUMENTS 4,473,047 A * 9/1984 Jakuba et al. ..... 123/323
5,224,460 A * 7/1993 Havstad et al. ..... 123/568.14
(Continued)

FOREIGN PATENT DOCUMENTS

DE 3943426 4/1991
DE 4236877 5/1993
(Continued)

OTHER PUBLICATIONS

English abstract for DE-3943426.
(Continued)

*Primary Examiner* — John Kwon
*Assistant Examiner* — Johnny H Hoang
(74) *Attorney, Agent, or Firm* — Fishman Stewart Yamaguchi PLLC

(57) ABSTRACT

In a valve train of a reciprocating piston combustion engine, comprising cylinders controlled by at least three valves (1, 2) actuated by lobes (5, 6) of a camshaft (3; 4), wherein at least two valves (1; 2) operate equally in terms of function as intake or outlet valves (1; 2), the engine driving and/or braking operation are to be improved. For this purpose, such a valve train is characterized in that the lobes (3, 4) of the camshafts (3, 4) actuating the at least two equally operating valves in terms of function, which are primary and secondary valves (1*p*, 1*s*; 2*p*, 2*s*), are configured so that they are phase-adjustable in relation to each other.

16 Claims, 5 Drawing Sheets

Figure 1:
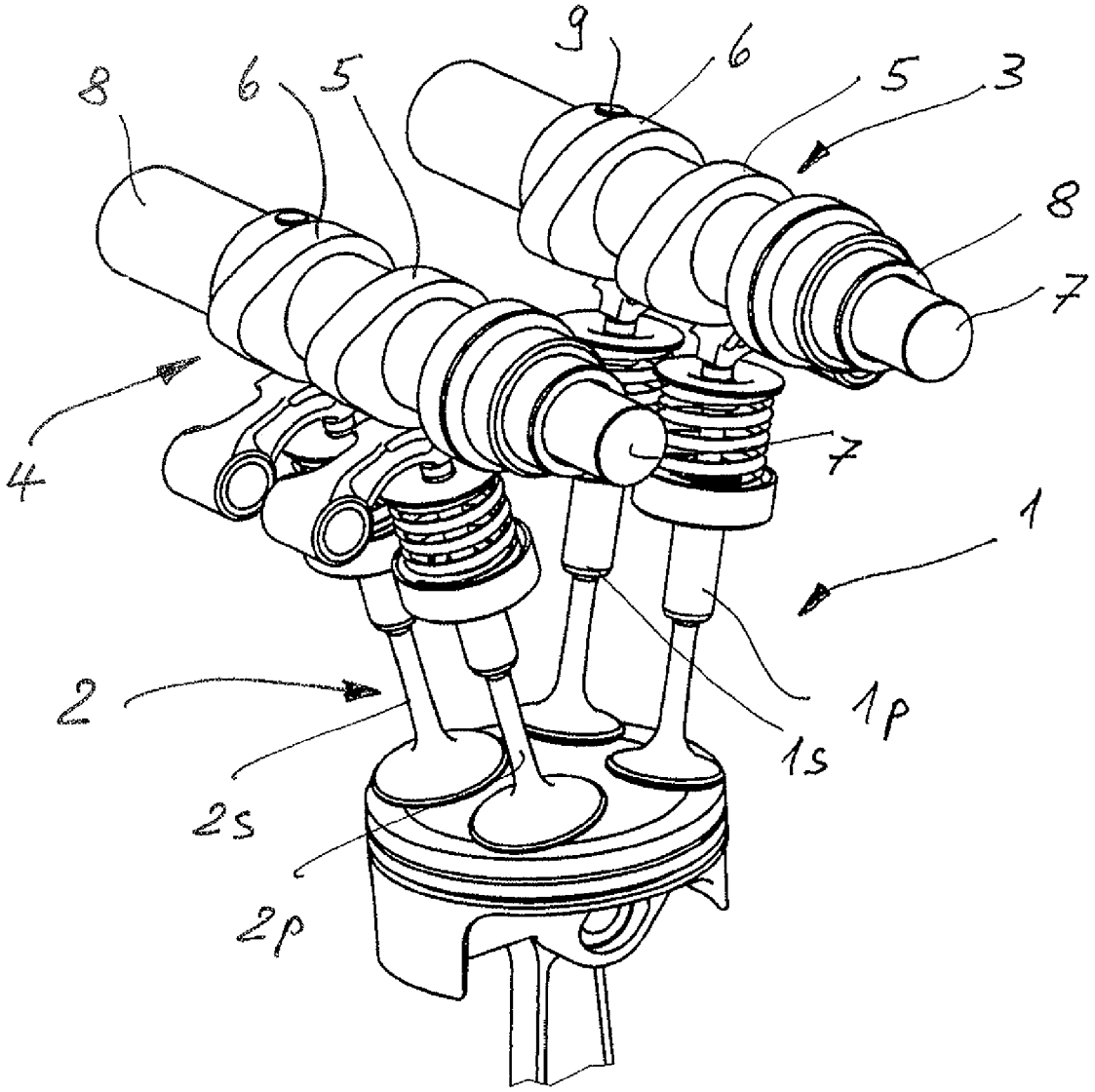

(51) Int. Cl.

| | |
|---|---|
| ***F01L 1/047*** | (2006.01) |
| ***F01L 1/26*** | (2006.01) |
| ***F01L 13/06*** | (2006.01) |

(56) References Cited

U.S. PATENT DOCUMENTS

| | | | | |
|---|---|---|---|---|
| 5,647,319 | A | 7/1997 | Uehara et al. | |
| 6,223,846 | B1 * | 5/2001 | Schechter | 180/165 |
| 6,244,257 | B1 * | 6/2001 | Hu | 123/568.14 |
| 6,293,238 | B1 * | 9/2001 | Harmon | 123/90.16 |
| 6,293,248 | B1 * | 9/2001 | Zsoldos et al. | 123/321 |
| 6,390,054 | B1 * | 5/2002 | Yang | 123/295 |
| 6,725,817 | B2 | 4/2004 | Methley et al. | |
| 7,231,998 | B1 * | 6/2007 | Schechter | 180/165 |
| 7,464,675 | B1 * | 12/2008 | Schechter | 123/90.15 |
| 7,520,259 | B2 * | 4/2009 | Barnes et al. | 123/299 |
| 7,565,896 | B1 * | 7/2009 | Yang | 123/321 |
| 7,895,979 | B2 * | 3/2011 | Lancefield et al. | 123/90.15 |
| 7,905,208 | B2 * | 3/2011 | Ruggiero et al. | 123/90.22 |
| 2001/0017118 | A1 * | 8/2001 | Shin | 123/90.43 |
| 2002/0002959 | A1 | 1/2002 | Suzuki | |
| 2002/0108600 | A1 * | 8/2002 | Houtz | 123/321 |
| 2003/0131805 | A1 * | 7/2003 | Yang | 123/27 R |
| 2005/0087170 | A1 * | 4/2005 | Rammer et al. | 123/321 |
| 2005/0235939 | A1 | 10/2005 | Wilke | |
| 2007/0199532 | A1 * | 8/2007 | Meintschel et al. | 123/90.17 |
| 2008/0215228 | A1 | 9/2008 | Krebber-Hortmann | |

FOREIGN PATENT DOCUMENTS

| | | |
|---|---|---|
| DE | 4313464 | 11/1993 |
| DE | 4419637 | 12/1994 |
| DE | 19526888 | 1/1997 |
| DE | 102004020124 | 11/2005 |
| DE | 60114519 | 1/2006 |
| DE | 102005031241 | 1/2007 |
| EP | 0640749 | 3/1995 |
| FR | 2709524 | 3/1995 |
| JP | 9-41925 C | 2/1979 |
| JP | 60147512 | 8/1985 |
| JP | 08-270425 | 10/1996 |
| JP | 08-0338215 | 12/1996 |
| JP | 10-266879 | 10/1998 |
| WO | WO-97/07324 | 2/1997 |

OTHER PUBLICATIONS

English abstract for DE-19526888.
English abstract for JP-60147512.
English abstract for FR-2709524.
English abstract EP-0640749.
English abstract for DE-4419637.
English abstract for DE-4313464.
English abstract for DE-4236877.
English abstract for JP9-41925.
English translation of JP Office Action for 2009-549832.
English translation for 08-270425.
English translation for 10-266879.
English translation of office action for JP2009-549832.

* cited by examiner (a)

(b)

(a)

(b)

VALVE TRAIN OF A RECIPROCATING PISTON COMBUSTION ENGINE

CROSS-REFERENCE TO RELATED APPLICATION

This application is a National Stage application which claims the benefit of International Application No. PCT/EP2008/051805 filed Feb. 14, 2008, which claims priority based on German Paten Application No. 102007007758.2, filed Feb. 16, 2007, both of which are hereby incorporated by reference in their entirety.

The invention relates to a valve train of a reciprocating piston combustion engine according to the preamble of claim 1 and is concerned with the problem of improving the combustion engine driving and/or braking operation by means of special constructive configurations of the valve train as well as furthermore improving the valve control that is thereby possible.

This problem is solved by a valve train of the generic type through a configuration according to the characterising feature of claim 1.

Advantageous and appropriate configurations are the subject matter of the subclaims.

The invention is based on the general conception of, in an engine cylinder having at least two valves operating equally in terms of function as intake or outlet valves, having said valves that operate equally in terms of function during a four-stroke cycle act upon at least intermittently asynchronously on the respectively associated valves. According to the invention, a camshaft that has within it lobes that are rotatable about one another, that is to say phase adjustable, serves to achieve such an asynchronous effect. For example, a primary and a secondary lobe can be provided in two valves that operate equally in terms of function and that are controllable by such a camshaft. If the camshaft used is of the type that consists of two shafts that are mounted concentrically within one another and are rotatable against one another, the primary lobe can, for example, be fixedly connected to the external shaft and, with a mounting on the external shaft, the secondary lobe can be fixed connected to the inner shaft. With a camshaft constructed in such a manner, in the instance that the outer shaft is driven, the secondary lobe is rotatable by means of the primary lobe. Such camshafts, which are known as so-called adjustable camshafts, are known from the prior art so is it not necessary to further discuss herein their construction and function.

In the instance in which in an engine cylinder having at least two valves that operate equally in terms of function asynchronously with each other that are controlled in certain sections of a four-tact cycle by primary and secondary lobes phase-shifted against one another correspondingly arranged within the camshaft, then the driving and/or braking operation of a combustion engine controlled by such valves is changed according to the desired specifications. Examples of such specifications that can be achieved by such asynchronous actuations of valves that operate equally in terms of function of an engine cylinder are individually explained in the following.

Figure 2:
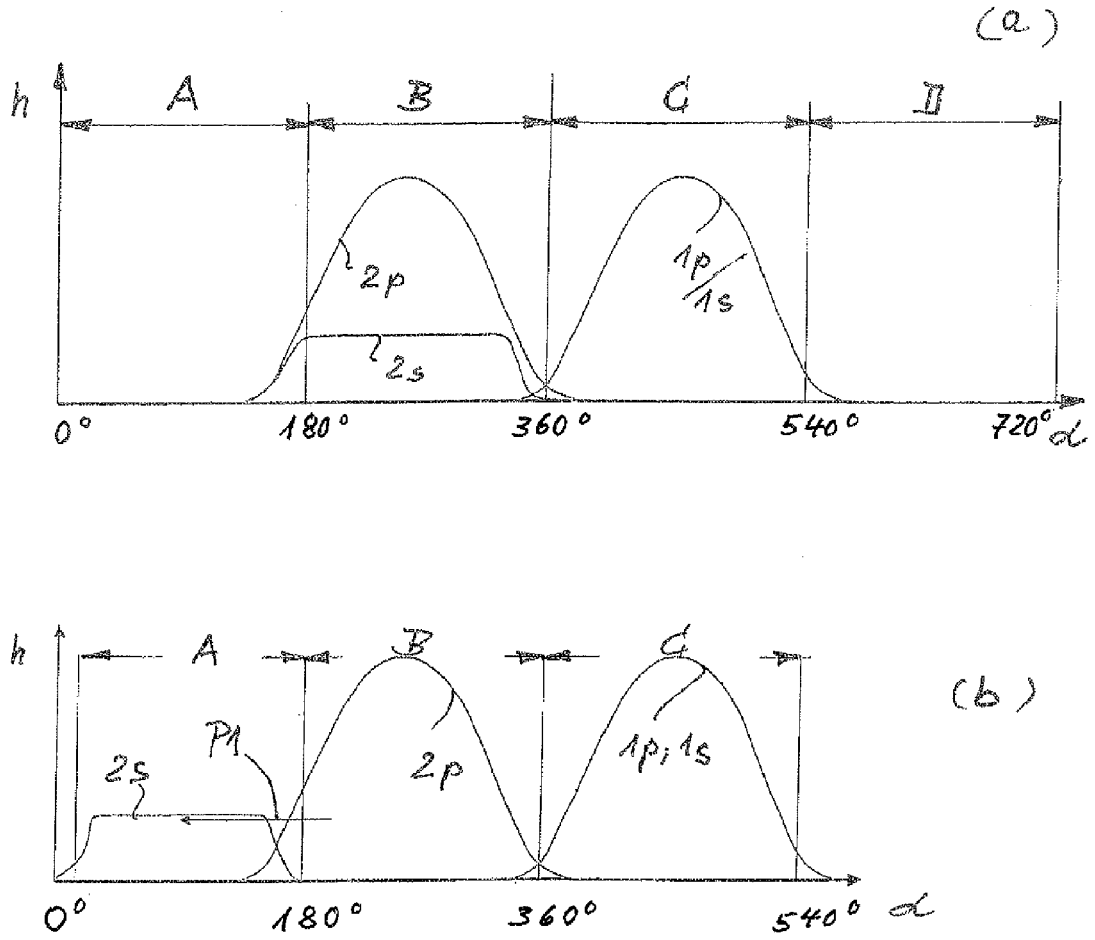
Figure 3:
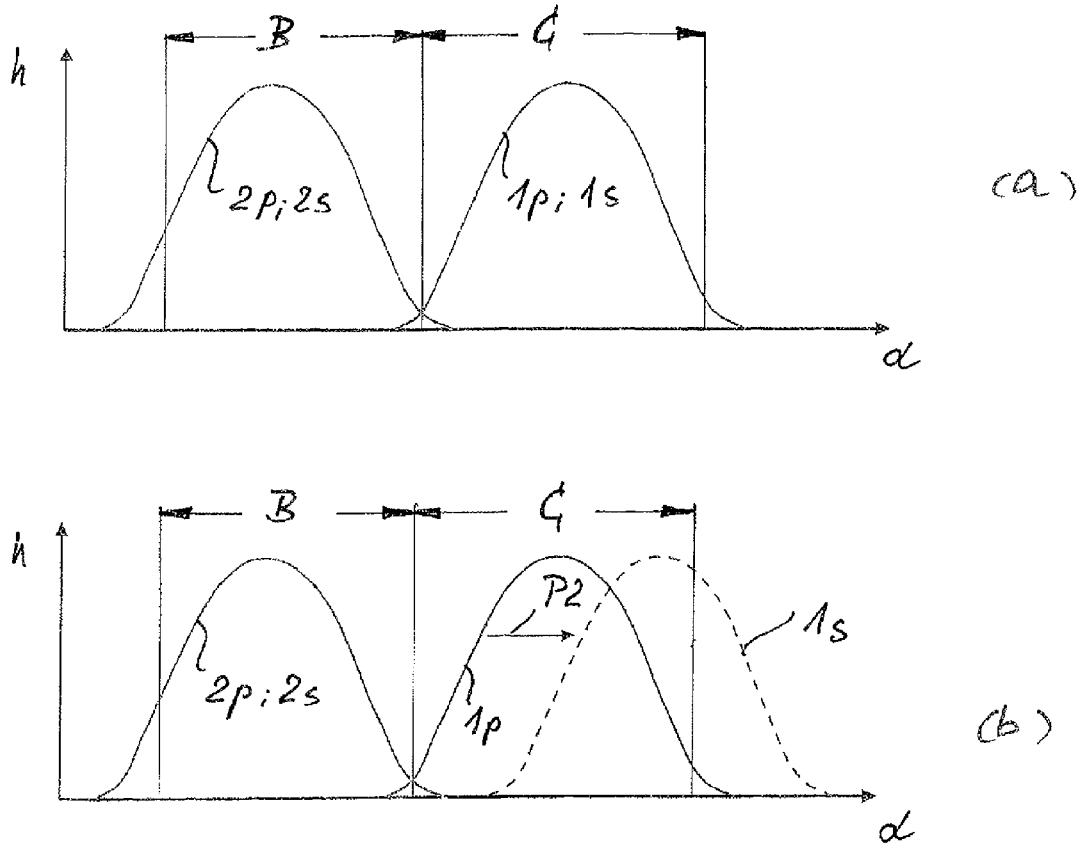
Figure 4:
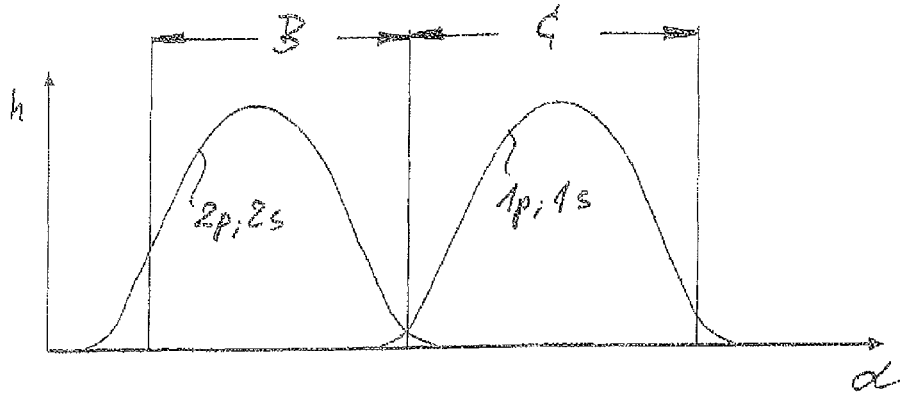
Figure 4:
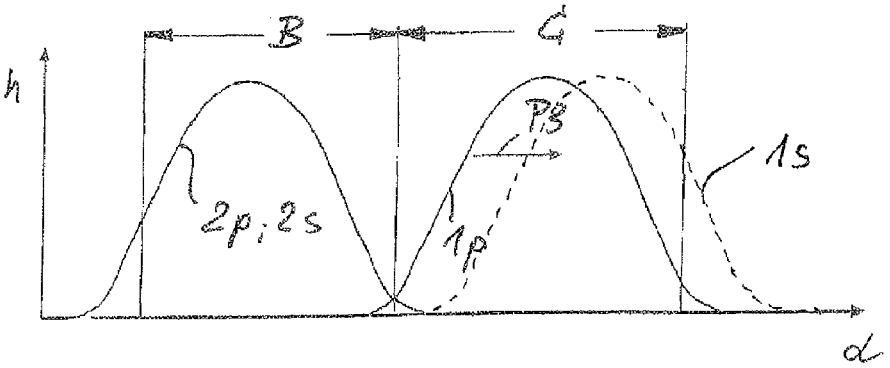
Figure 5:
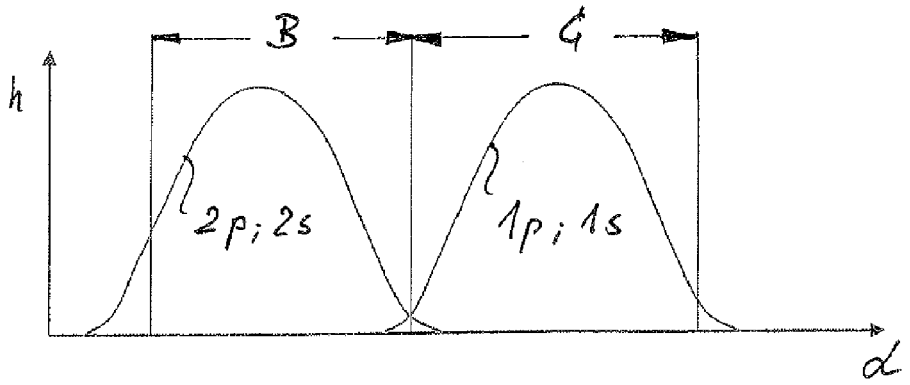
Figure 5:
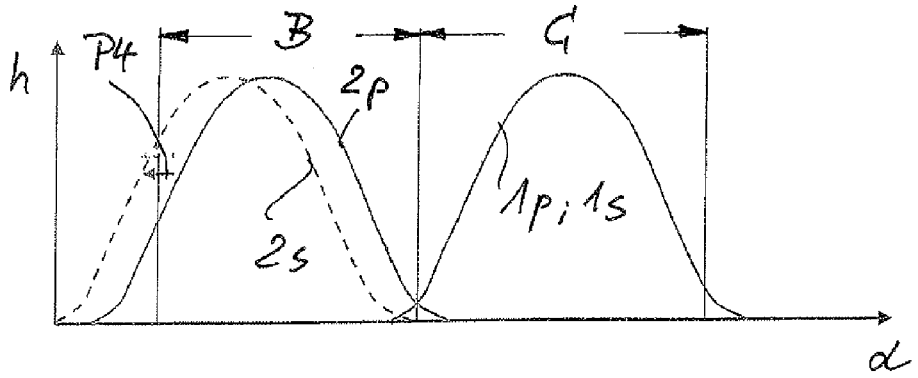

Drawings and diagrams are provided for this explanation. Individually, the following drawings show:

in FIG. 1 a perspective schematic representation of a four-valve engine cylinder having a valve train comprising two respectively adjustable camshafts, in FIG. 2 a valve control diagram with a comparison between an engine drive in part a of the drawing and "a" brake drive in part "b" of the drawing, in FIG. 3 a comparison between two valve control diagrams for an engine drive having median engine speed (part "a" of the drawing) and low engine speed with reference to an improvement of the charge movement in the instance of low engine speeds (part "b" of the drawing), in FIG. 4 a comparison of valve control diagrams for an engine speed (drawing part "a") and a full-load engine operation with reference to an improved engine cylinder charging that can be achieved by the control diagram (drawing part "b"), in FIG. 5 a comparison of valve control diagrams for an engine partial load operation (drawing part "a") and an engine full load operation with reference to improved engine cylinder scavenging (drawing part "b").

FIG. 1

In the four-valve engine cylinder schematically shown in FIG. 1, including valve train, a camshaft acts on two intake valves 1 as well as two outlet valves 2 as a adjusting element, namely a first camshaft 3 acting on the intake valve 1 and a second camshaft 4 acting on the outlet valve 2. The intake and outlet valves 1, 2 that are respectively present as pairs, each comprise primary and secondary valves, namely a primary intake valve in the 1*p* in the case of the intake valves 1 and a secondary intake valve 1*s* on the one hand, and on the other in the case of the outlet valves, a primary outlet valve 2*p* as well as a secondary outlet valve 2*s*. Both camshafts 3, 4 each have two lobes that are rotatable against one another, that is to say they are phase-adjustable, namely a primary lobe 5 as well as a secondary lobe 6. Both camshafts 3, 4 each consist of two, shafts that are rotatable against one anther and concentrically mounted in one another, namely an internal shaft 7 and a tubular external shaft 8. The primary lobes 5 are each fixedly connected to the external shaft and the secondary lobes 6 are fixedly connected to the internal shaft 7. The secondary lobes 6 fixedly connected to the internal shaft 7 are rotatably mounted on external shaft 8 and each is connected in a rotatably fixed manner to the internal shaft 7 by means of a pin 9. The camshafts 3, 4 can, for example, be driven by the respective external shaft 8. In this instance, the secondary lobes 6 can be phase-adjusted with respect to the primary lobe 5 rotating with the drive speed of the respective camshafts.

Through a reciprocal phase adjustment between a primary and secondary lobe 5; 6, respectively, of a camshaft, different engine controls in the engine and brake operation can be obtained by asynchronously, counter-to-one-another controlled intake or outlet valves 1, 2.

In an engine cylinder with a valve device including a valve train according to FIG. 1, the invention consists in that at least two valves that operate equally in terms of function, that is to say the intake or outlet valves 1; 2 can be respectively actuated against each other by a phase adjustment between primary and secondary lobes 5, 6 of a camshaft 3 or 4 actuating the valves that operate equally in terms of function. It can be sufficient to actuate only one type of the valves 1, 2 that operate equally in terms of function, that is to say either only the intake valve 1 of only the outlet valve 2. Moreover, it is evident that a combination is also possible wherein for one realisation of the invention, valves 1; 2 that operate equally in terms of function must be available as driveable against one another and, in certain engine operational states, must also actually be actuated against one another.

Examples of engine drive and braking operations that can be obtained according to the invention show different valve-control diagrams in the figures that are explained in greater detail below.

FIG. 2

Here, in comparison to one another, is shown in figure part "a" a control curve for the valves 1, 2 of an engine cylinder according to FIG. 1 for an engine operation, while figure part "b" shows a control curve for a braking operation according to the invention.

In both control diagrams, each of the angles of rotation of the crankshaft "α" is plotted on the abscissa for a full combustion stroke over 360°, while the length of stroke "h" of valves 1, 2 is plotted on the ordinate. Corresponding to a complete crankshaft rotation, the associated engine strokes are given in the diagrams, namely the strokes "A=operation", "B=discharge", "C=intake", and "D=compression".

The engine operation control diagram in the figure part "a" shows that the maximally attainable strokes "h" of both of the outlet valves 2*p*, 2*s* are different. According thereto, the secondary valve 2*s* has a considerably smaller maximal stroke than the primary outlet valve 2*p*. In order for this to be the case, the secondary outlet valve 2*s* operates during the "discharge" stroke nearly during the entire stroke time with maximal opening stroke.

For an optimal braking operation, the secondary outlet valve 2*s* is asynchronously driven with regard to the primary outlet valve 2*p*, and namely to the effect that the secondary outlet valve is nearly open during the entire "working" stroke (A). The direction of the corresponding phase displacement in the braking operation with regard to the engine operation is indicated in the figure part "b" with an arrow "P1".

The opening and closing times of the valves 1, 2 are given in the control diagrams by specification of the camshaft angle "∝" associated therewith.

By means of the phase displacement in the control of the secondary outlet valve 2*s* with respect to the primary outlet valve 2*p* through which phase displacement the secondary outlet valve 2*s* has already opened ahead of time as much as possible during the "operation" stroke (A), an increased braking performance is achieved in the engine operation and braking operation.

FIG. 3

In FIG. 3, the control diagrams relate in figure part "a" to an engine operation with a greater number of revolutions and in figure part "b" to an engine operation according to the invention with a lower number of revolutions. Through the phase displacement shown in figure part 2 in the direction of the arrow P2 of the secondary intake valve 1*s*, an improved charging motion is achieved in the "intake" stroke (C) through the late opening of the secondary valve 2*s*, by means of which an improved combustion can be achieved in this operational state. The meaning of the configuration and the designations of the control diagrams in FIG. 3 correspond to those of FIG. 2.

FIG. 4

The control diagrams relate in figure part "a" to an engine partial load operation with a greater number of revolutions and to an engine full load operation in figure part "b".

While the intake and outlet valves 1, 2 are operated synchronously in the engine operation according to figure part "a", insofar as they operate equally in terms of function, the intake valves are phase displaced against one another in the intake stroke corresponding to the arrow "P3" in accordance with the representation in figure part "b".

Through an engine operation according to the control curve in FIG. 4*b*, dynamic post-charging effects can be achieved with the late-closing secondary valve 2*s*. All in all, an increased volumetric efficiency can hereby be achieved and thus in turn an increase in engine performance.

FIG. 5

The control diagrams in figure part 1 relate to an engine partial load operation and in figure part b to an engine full load operation according to the invention. The difference between both of the control diagrams consists in the fact that the outlet valves 1, 2 are actuated against one another in a phase-displaced manner. The secondary outlet valve 2*s* is opened ahead of time in comparison to the primary outlet valve 2*p*. The direction of the phase displacement concerned between both of the outlet valves is indicated by an arrow "P4". By means of the control curve according to the invention according to FIG. 5*b*, an improved scavenging is achieved, in particular during full load, by a discharging ahead of time (discharge stroke "B") through the secondary outlet valve 2*s* and a long expulsion of the primary outlet valve 2*p*, thereby attaining an improved fresh gas charging. In this manner, the combustion is improved overall.

All of the features represented in the description and in the following claims can be pertinent to the invention individually and collectively in arbitrary combination.

The invention claimed is:

1. A valve train of a reciprocating piston combustion engine, comprising:

at least three valves actuated by lobes of a camshaft, wherein the at least three valves are associated with a respective engine cylinder, and at least two of the at least three valves operate as a primary and a secondary valves, and wherein the lobes of the camshaft associated with the at least two of the at least three valves are phase adjustable with respect to one another, wherein the at least two of the at least three valves are outlet valves that are associated with the respective engine cylinder, and wherein an adjustable setting of the lobes is configured to open one of the outlet valves during an operation stroke of the engine to selectively perform an engine braking operation.

2. The valve train as specified in claim 1, wherein for the at least two of the at least three outlet valves of each of the respective engine cylinders, at least one of the at least two of the at least three outlet valves is associated with a lobe that opens the corresponding outlet valve to a lesser degree relative to an additional outlet valve of the respective engine cylinder.

3. The valve train as specified in claim 2, wherein the outlet valve that opens to a lesser degree is opened by the corresponding lobe in the engine braking operation in an operation stroke of the respective engine cylinder.

4. The valve train as specified in claim 2, wherein the outlet valve that opens to a lesser degree operates with a first maximal opening stroke for a first portion of an engine stroke, the outlet valve that opens to a greater degree operates with a second maximal opening stroke for a second portion of an engine stroke, wherein the first portion of the engine stroke is longer than the second portion of the engine stroke.

5. The valve train as specified in claim 1, wherein the operation stroke is one of four engine strokes corresponding to a combustion rotation of 360 degrees.

6. The valve train as specified in claim 5, wherein the operation stroke is a combustion stroke followed by a discharge stroke, an intake stroke and a compression stroke.

7. A valve train of a reciprocating piston combustion engine, comprising:

a first camshaft acting on an intake valve for an engine cylinder; and a second camshaft having a primary lobe and a secondary lobe phase-adjusted with respect to the primary lobe, and the primary and secondary lobes acting on a respective one of a primary outlet valve and a secondary outlet valve of the engine cylinder;

wherein an adjustable setting of the primary and secondary lobes is configured to open one of the outlet valves during an operation stroke of the engine to selectively perform an engine braking operation.

8. The valve train as specified in claim 7, wherein the second camshaft further comprises:

a tubular external shaft; and an internal shaft concentrically mounted in the tubular external shaft;

wherein the primary lobe is fixedly connected to the external shaft by a pin and the secondary lobe is rotatably fixed to the internal shaft by another pin.

9. The valve train as specified in claim 8, wherein the primary lobe is configured to actuate the primary outlet valve during at least a portion of a discharge stroke, and the adjustable setting of the secondary lobe is configured to actuate the secondary outlet valve during at least a portion of an operation stroke.

10. The valve train as specified in claim 9, wherein the primary lobe is configured to actuate the primary outlet valve during the discharge stroke, and the adjustable setting of the secondary lobe is configured to actuate the secondary outlet valve during a period consisting of the operation stroke.

11. The valve train as specified in claim 7, wherein the first camshaft further comprises:

a tubular external shaft;

an internal shaft concentrically mounted in the tubular external shaft;

a primary lobe connected to the tubular external shaft by a pin; and a secondary lobe connected to the internal shaft by another pin wherein the intake valve includes a primary intake valve and a secondary intake valve, and the primary and secondary lobes act on a respective one of the primary intake valve and the secondary intake valve;

wherein an adjustable setting of the primary and secondary lobes is configured to at least one of open the secondary intake valve after opening the primary intake valve and close the secondary intake valve after closing the primary intake valve.

12. The valve train as specified in claim 11, wherein the adjustable setting of the primary and secondary lobes is configured to actuate the secondary intake valve during at least a portion of a compression stroke.

13. A reciprocating piston combustion engine, comprising:

a reciprocating piston including at least three valves actuated by lobes of a camshaft, wherein the at least three valves are associated with a respective engine cylinder, and at least two of the at least three valves operate as a primary and a secondary valves, and wherein the lobes of the camshaft associated with the at least two of the at least three valves are phase adjustable with respect to one another, wherein the at least two of the at least three valves are outlet valves that are associated with the respective engine cylinder, and wherein an adjustable setting of the lobes is configured to open one of the outlet valves during an operation stroke of the engine to selectively perform an engine braking operation.

14. The reciprocating piston combustion engine as specified in claim 13, wherein for the at least two of the at least three outlet valves of each of the respective engine cylinders, at least one of the at least two of the at least three outlet valves is associated with a lobe that opens the corresponding outlet valve to a lesser degree relative to an additional outlet valve of the respective engine cylinder.

15. The reciprocating piston combustion engine as specified in claim 14, wherein the outlet valve that opens to a lesser degree is opened by the corresponding lobe in the engine braking operation in an operation stroke of the respective engine cylinder.

16. The reciprocating piston combustion engine as specified in claim 14, wherein the outlet valve that opens to a lesser degree operates with a first maximal opening stroke for a first portion of an engine stroke, the outlet valve that opens to a greater degree operates with a second maximal opening stroke for a second portion of an engine stroke, wherein the first portion of the engine stroke is longer than the second portion of the engine stroke.

* * * * *